United States Patent [19]

Crisci

[11] Patent Number: 4,884,707

[45] Date of Patent: Dec. 5, 1989

[54] WATER BOTTLE CAP

[75] Inventor: Harry E. Crisci, New Castle, Pa.

[73] Assignee: Northern Engineering and Plastics Corp., New Castle, Pa.

[21] Appl. No.: 303,130

[22] Filed: Jan. 30, 1989

[51] Int. Cl.[4] ..... B65D 41/48

[52] U.S. Cl. ..... 215/256; 215/317; 215/344

[58] Field of Search ..... 215/256, 254, 344, DIG. 1, 215/317

[56] References Cited

U.S. PATENT DOCUMENTS

| | | | |
|---|---|---|---|
| 3,120,900 | 2/1964 | Faulstich | 215/46 |
| 3,392,860 | 7/1968 | Faulstich | 215/40 |
| 3,392,862 | 7/1968 | Faulstich | 215/41 |
| 3,473,685 | 10/1969 | Karlan | 215/DIG. 1 |
| 3,840,137 | 10/1974 | Faulstich | 215/256 |
| 4,066,180 | 1/1978 | Sanchez | 215/317 X |
| 4,106,653 | 8/1978 | Martinelli | 215/344 X |
| 4,416,383 | 11/1983 | Frahm | 215/344 X |

*Primary Examiner*—Donald F. Norton
*Attorney, Agent, or Firm*—Harpman & Harpman

[57] ABSTRACT

A resilient plastic bottle cap for a five-gallon water bottle of the type having a crowned neck including an external upper bead, the cap having a top portion with a depending skirt which fits snuggly around the exterior of the bottle neck and so long as it remains intact prevents tampering with the contents. An inner annular groove divides the depending skirt into upper and lower portions and an inner groove is formed between the annular groove and the lower edge of the lower part of the depending skirt and adjacent a tab so that the lower part of the skirt may be torn off to permit easy removal of the cap from the water bottle. Several inturned annular flanges are formed on the inner surface of the depending skirt to form multiple flexible seals and retaining means engaging the external upper bead of the water bottle.

3 Claims, 1 Drawing Sheet

WATER BOTTLE CAP

BACKGROUND OF THE INVENTION

1. Technical Field

This invention relates to resilient plastic bottle caps for five-gallon water bottles and the like and the combination thereof.

2. Description of the Prior Art

Prior bottle caps of this type may be seen in U.S. Pat. Nos. 3,120,900, 3,392,860, 3,392,862 and 3,840,137.

The present invention provides dual sealing and fastening of a resilient molded plastic water bottle cap that includes a top portion with a depending annular skirt having an annular groove defining an upper portion and a lower portion thereof, several inturned annular flanges in the upper portion form multiple flexible dual liquid seals and fastening configurations.

SUMMARY OF THE INVENTION

A resilient plastic bottle cap for five-gallon water bottles, either glass or molded rigid plastic with appropriate neck configurations, takes the form of a top portion with an annular depending skirt on its peripheral edge and having an inner annular groove defining an upper skirt portion and a lower skirt portion. The lower skirt portion forms a tear skirt and a pull tab is integrally formed with the tear skirt and an upwardly extending groove is formed in the tear skirt adjacent the pull tab so as to communicate with the annular groove so that the tear skirt portion may be torn off to facilitate easy removal of the cap to dispense the contents of the water bottle. The upper portion of the tear skirt has several vertically spaced inturned annular flanges forming multiple flexible seals and fastening configurations with at least one of the multiple flexible seals engaging an external bead of the finish of the neck portion of the water bottle adjacent the upper end thereof and others of the multiple flexible seals and fastening configurations engaging other and opposite surfaces of the external bead with all of said multiple flexible seals being located above the annular groove in the depending skirt and below the top of said cap.

DESCRIPTION OF THE PREFERRED EMBODIMENT

Figure 1:
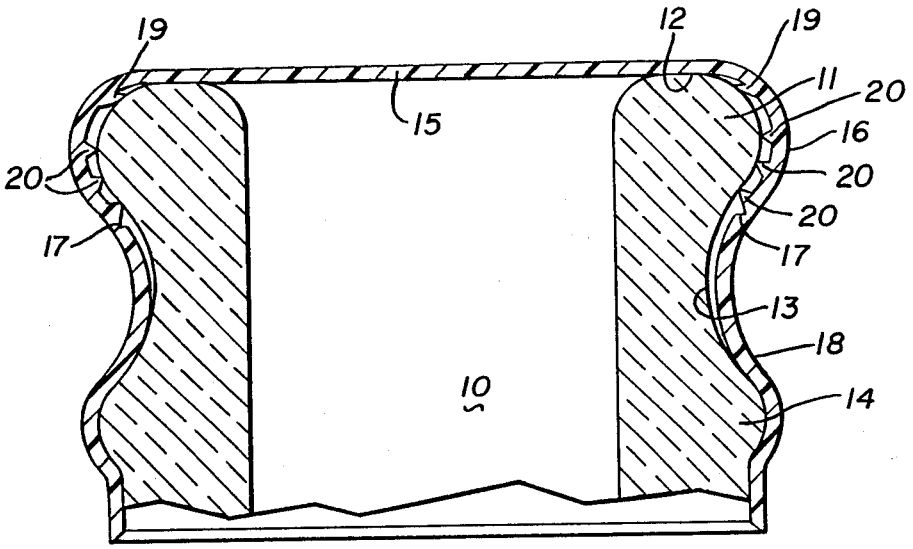
FIG. 1 is a vertical section of the resilient plastic bottle cap and a portion of the neck of the water bottle on which the cap is applied showing the multiple flexible seals and fastening configurations.

By referring to the drawing and FIG. 1 in particular, a vertical section through the resilient plastic bottle cap positioned in stretched sealing and fastening relation on the crowned neck 10 of a five-gallon water bottle of the type having an external upper annular bead 11 immediately adjacent a transversely flat upper end 12 and an inwardly-outwardly curved portion 13 and a second external annular bead 14. The innermost area of inwardly curved portion 13 being of a substantially lesser minimum diameter than the diameter of said upper external annular bead 11 and the bottle neck 10. The second external annular bead 14 being of the same diameter as the upper external annular bead 11 of the crowned neck 10 of the five-gallon water bottle.

Still referring to FIG. 1 of the drawings, it will be seen that the resilient plastic bottle cap of the combination is illustrated in stretched and distorted position on the crowned neck 10 and comprises a top portion 15 having around its periphery a depending upper skirt 16 of a length sufficient to engage the external upper annular bead 11 from the upper end 12 to and including the lower portion thereof. An inner annular groove 17 forming a frangible tear line separates the upper skirt portion 16 from a substantially longer lower tear skirt 18. An inturned annular flexible sealing flange 19 is formed on the inner surface of the upper skirt 16 adjacent the periphery of the top portion 15 for engagement with the outer surface of the external upper annular bead 11 of the crowned neck 10 and spaced above several internal annular flexible sealing and fastening flanges 20 which are spaced with respect to one another and positioned for sealing and fastening engagement with the external upper annular bead 11 so that some of the annular flexible sealing and fastening flanges 20 are positioned below the area of maximum diameter of the external upper annular bead 11 and in substantially oppositely disposed relation to the internal annular flexible sealing flange 19. The lowermost one of the annular flexible sealing and fastening flanges 20 is preferably located immediately adjacent the inner annular groove 17 which forms a frangible wall between the upper skirt portion 16 of the plastic bottle cap and the lower tear skirt portion 18 thereof.

Figure 2:
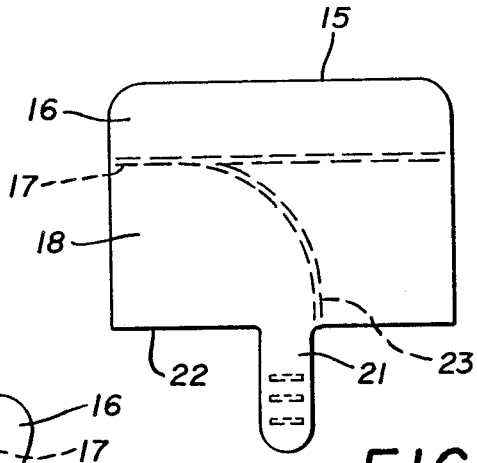
FIG. 2 is a side elevation of the resilient plastic bottle cap showing the pull tab and upwardly extending inner groove in the tear skirt.

By referring now to FIG. 2 of the drawings which is a side elevation of reduced size with respect to FIG. 1 of the drawings, it will be seen that the as molded shape of the resilient plastic bottle cap includes the top portion 15 and the upper skirt portion 16 above the frangible wall formed by the inner annular groove 17 and the lower tear skirt portion 18 which are formed in substantially vertical alignment and of a diameter equal to or less than the external diameter of the lower annular innermost curved portion 13 of the crowned neck 10 of the water bottle. A depending tab 21 extends from a lower edge 22 of the tear skirt portion 18 of the resilient plastic body cap and adjacent an inner groove 23 therein which extends from a point adjacent the tab 21 to the inner annular groove 17 heretofore referred to.

It will be seen that the initial diameter of the resilient plastic bottle cap is such that it must stretch and distort when it is pushed downwardly onto the crowned neck of the five-gallon water bottle. In so doing, it is caused to conform with the exterior surfaces comprising the finish of the crowned neck in such manner that the internal annular flexible sealing flange 19 sealingly engages the upper portion of the external upper annular bead 11 so as to insure a water-tight seal and that the several annular flexible sealing and fastening flanges 20 spaced therebelow engage the outermost and under portions of the external upper annular bead 11 to form both liquid tight seals and fastening configurations, it being observed that all of the inturned annular flexible flanges 19 and 20 distort sufficiently be reason of the elastic characteristics of the resilient plastic from which the bottle cap is molded to insure continuous sealing and fastening engagement with the finish of the crowned neck portion of the five-gallon water bottle.

The novel structure is such that the several problems heretofore common in the art are eliminated and chiefly among these problems has been the leakage of water from the prior art closures occasioned by the common practice of transporting filled five-gallon water bottles on vehicles in which the supporting racks are only slightly angled upwardly from horizontal. Movement of the vehicle imparts motion to the water in the five-gallon water bottles creating forces directly engaging the closure and very frequently causing leakage and from time to time moving the prior art closures away from the water bottles.

Figure 3:
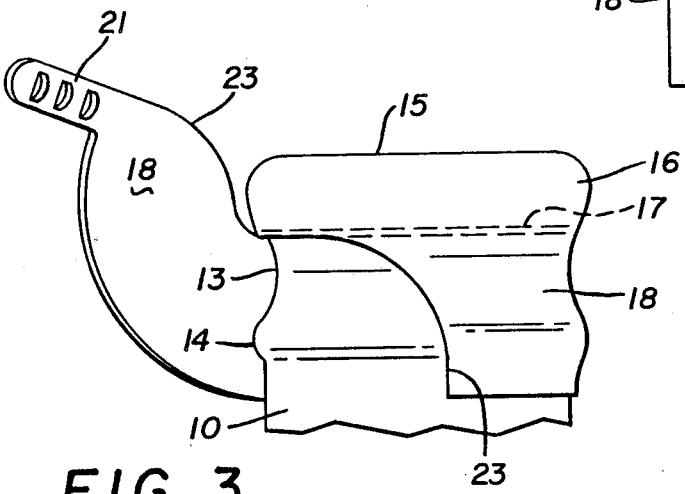
FIG. 3 is a side elevation of the resilient plastic bottle cap and the upper first end of a bottle neck showing the tear skirt being torn preliminary to the removal of the same from the remainder of the cap.
Figure 4:
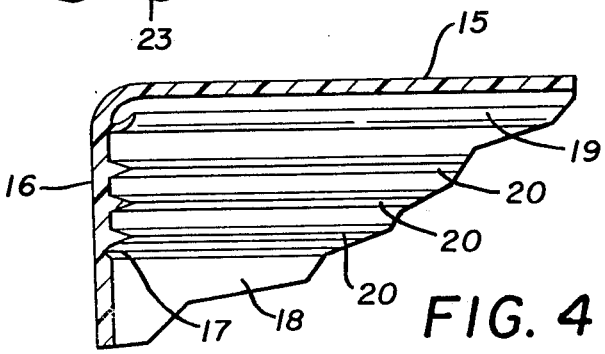
FIG. 4 is an enlarged vertical section of a portion of the resilient plastic bottle cap in its as molded configuration.

By referring again to the drawings and FIG. 3 thereof, it will be seen that a neck portion 10 of a five-gallon water bottle has been disclosed in side elevation with the resilient plastic bottle cap of the present invention positioned thereon and partially removed therefrom in that the tab 21 of the tear skirt or lower portion 18 of the cap has been grasped and pulled upwardly and away from the bottle, first along the tear line defined by the inner groove 23 and then progressively around the annular inner groove 17. When the tear skirt or lower portion 18 of the depending skirt has been completely removed, the upper portion of the resilient plastic bottle cap remains including the top portion 10 and the upper skirt 16 which remains on the crowned neck of the water bottle by reason of the hereinbefore described inturned annular flexible sealing flange 19 and the several inturned annular flanges 20 (see FIG. 4) which are disposed above the inner annular groove 17 which defines the frangible annular wall permitting the tear skirt portion 18 to be completely removed. The characteristics of the remaining upper skirt 16 and its internal configurations when stretched enable it to continue to provide a liquid tight seal and a considerable resistance to removal which is particularly advantageous in the event part of the tear skirt 18 is accidentally removed in the handling of the water bottle prior to its delivery and use. Additionally, the sealing and fastening characteristics of the resilient plastic bottle cap comprising the top portion 15 and the upper skirt 16 enable it to be reapplied to the water bottle if desired where it will continue to provide a liquid tight seal and substantial fastening engagement with the neck finish of the crowned neck of the five-gallon water bottle. The resilient plastic bottle cap disclosed herein preferably molded of polyethylene or other suitable plastic material having the properties of being flexible and stretchable, it being observed that the top portion 15 and the upper skirt 16 and lower or tear skirt 18 are of substantially the same thin wall thickness which contributes to the ability of the resilient plastic bottle cap to substantially change its configuration when applied to the crowned neck finish of the water bottle as hereinbefore described.

It will thus be seen that the resilient plastic bottle cap for five-gallon water bottles disclosed herein has novel fluid sealing and fastening means when compared with the bottle caps hereinbefore known in the art and in particular those which are primarily used for the transport and dispensing of drinking water.

Although but one embodiment of the present invention has been illustrated and described, it will be apparent to those skilled in the art that various changes and modifications may be made therein without departing from the spirit of the invention and having thus described my invention what I claim is:

1. In combination a rigid water bottle having a neck with a flat annular upper end, a first annular external bead on said neck adjacent said flat end and a second annular external bead on said neck spaced below said first bead, a downwardly inwardly-outwardly curving portion having a minimum diameter area between said first and second annular beads; and a cap of a resilient flexible plastic material having thin wall top and skirt portions and being of a diameter smaller than said minimum diameter area of said downwardly-inwardly curving portion of said neck, an inturned annular flexible sealing flange on said skirt portion adjacent said top portion positioned for registry with said first annular external bead, several secondary inturned annular sealing and fastening flanges on said skirt portion spaced below said flexible sealing flange and positioned for registry with a lower portion of said first annular external bead on said neck, said skirt having an annular groove therein below said secondary inturned annular flanges and means on said skirt below said annular groove and communicating therewith by which said skirt below said annular groove can be torn away, whereby said cap is stretched when positioned on said neck of said water bottle so as to tightly engage said first and second annular sealing and fastening flanges on said first annular bead and said downwardly inwardly-outwardly curving portion of said neck.

2. The combination set forth in claim 1 and wherein said top portion and skirt portion are formed of substantially the same thin wall thickness facilitating the distortion of said resilient flexible plastic material when said cap is positioned on said neck of the water bottle and conforms therewith.

3. The combination set forth in claim 1 and wherein said skirt portion is of a length sufficient to engage said second external annular bead and a portion of said bottle neck therebelow.

* * * * *